United States Patent [19]

Loomba

[11] 4,071,929

[45] Feb. 7, 1978

[54] MOUNTING FOR BUCKLE

[75] Inventor: Yogendra Singh Loomba, Washington, Mich.

[73] Assignee: Allied Chemical Corporation, Morris Township, N.J.

[21] Appl. No.: 621,971

[22] Filed: Oct. 14, 1975

[51] Int. Cl.[2] ..... A44B 11/26

[52] U.S. Cl. ..... 24/230 A; 24/230 R

[58] Field of Search ..... 24/230 AL, 230 A, 230 AU, 24/230 AM, 230 AK, 230 AT; 297/385

[56] References Cited

U.S. PATENT DOCUMENTS

| | | | |
|---|---|---|---|
| 3,555,632 | 1/1971 | Lindblad | 24/230 AL |
| 3,704,633 | 12/1972 | Iverson | 24/230 AL |
| 3,763,523 | 10/1973 | Lindblad | 24/230 AL |
| 3,789,492 | 2/1974 | Klink | 24/230 AL |
| 3,877,115 | 4/1975 | Quinting | 24/230 AL |
| 3,895,196 | 7/1975 | Lewis | 24/230 A |
| 3,911,236 | 10/1975 | Poulsen | 24/230 AL |

FOREIGN PATENT DOCUMENTS

| | | | |
|---|---|---|---|
| 2,107,661 | 8/1972 | Germany | 24/230 AU |
| 2,334,388 | 1/1975 | Germany | 24/230 A |

*Primary Examiner*—Bernard A. Gelak
*Attorney, Agent, or Firm*—Roger H. Criss

[57] ABSTRACT

A ferrule is employed as a mounting means for attaching a buckle to a stiff member, such as a cable. The ferrule has an elongated shape, a buckle end and a mounting end. The ferrule has a means at the buckle end for attaching the ferrule to the buckle. The ferrule has a means at the mounting end of the ferrule for attaching the ferrule to the stiff member. The mounting end of the ferrule includes: a swagable material and a central bore for receiving the stiff member. Laminate plates of the buckle each have an interior opening adjacent to the mounting end of the plates. The buckle end of the ferrule includes a pair of flanges and planar surfaces which cooperate with the interior openings of the laminate plates for attaching the ferrule to the buckle.

8 Claims, 11 Drawing Figures

MOUNTING FOR BUCKLE

BACKGROUND OF THE INVENTION

The present invention relates to buckles, especially those buckles made of a plurality of laminate plates, such as those employed in a vehicle safety belt system. More particularly, the present invention relates to buckles which are mounted or anchored to a structure, such as a vehicle, by means of a stiff member, such as a cable. Still more particularly, the present invention relates to a mounting means for attaching the buckle to the stiff member.

Safety belt buckles for vehicle safety belt systems which include a plurality of laminate plates are disclosed in U.S. Pat. No. 3,969,795 filed Sept. 16, 1974 and 3,911,236 and 3,919,508 both filed Feb. 12, 1974. Cables to connect a safety belt buckle to a vehicle are disclosed in U.S. Pat. No. 3,785,701 to Gilmore; U.S. Pat. No. 3,555,632 to Lindblad; and Canadian Pat. No. 916,902 to Kangol Magnet Ltd. claiming priority based upon British patent application 53535/69.

An object of the present invention is to minimize design changes which would be necessary to attach a known laminate buckle to a stiff member for mounting on a structure, such as a vehicle. Another object of the present invention is to provide a means for attaching a laminate buckle to a stiff member which is strong, simple in design and convenient to manufacture and assemble.

SUMMARY OF THE INVENTION

The present invention is especially well adapted for use with an apparatus having a buckle and a stiff member for anchoring the buckle to a structure. The buckle includes a housing within the buckle. The housing comprises a plurality of laminate plates secured together, including a first plate, a second plate and a third plate. The second plate is arranged between the first plate and the third plate. The buckle, housing, first plate, second plate and third plate each have: a tongue end at which a tongue is inserted into the buckle and the housing; and a mounting end.

The present invention relates to an improvement for connecting the buckle to the stiff member, such as a cable. The improvement includes a ferrule having an elongated shape, a buckle end and a mounting end. The ferrule has a means at the buckle end of the ferrule for attaching the ferrule to the buckle. The ferrule has a means at the mounting end of the ferrule for attaching the ferrule to the stiff member.

The means at the mounting end of the ferrule for attaching the mounting end of the ferrule to the stiff member includes: a swagable material at the mounting end of the ferrule. The mounting end of the ferrule has a central bore therein for receiving the stiff member. The bore has a cross-sectional configuration which conforms to a cross-sectional configuration of a portion of the stiff member to be positioned in the bore. The bore extends along a central longitudinal axis of the ferrule from the mounting end of the ferrule to a point along the longitudinal axis of the ferrule between said buckle end and said tongue end.

The laminate plates each have an opening adjacent to the mounting end of the plates. The means at the buckle end of the ferrule for attaching the buckle end of the ferrule to the buckle includes: a first flange, a second flange, a first planar surface and a second planar surface.

The first planar surface and the second planar surface are located between the first flange and the second flange.

The first flange of the ferrule is disposed within the interior opening of the plates. The second flange of the ferrule is disposed at the mounting end of the plates. The second plate has a slot extending along a longitudinal axis of the second plate from the mounting end to the interior opening of the second plate. The planar surfaces of the ferrule are disposed within the slot of the second plate. The planar surfaces of the ferrule are also disposed between the first plate and the second plate.

A first portion of the first flange extends into the interior opening of the first plate. A second portion of the first flange extends into the interior opening of the third plate. A first portion of the second flange extends adjacent to the mounting end of the first plate. A second portion of the second flange extends adjacent to the mounting end of the third plate. The first plate and the third plate each have a mounting portion located between their mounting ends and their interior opening. The first portion of the first flange and the first portion of the second flange are each bent towards each other, engaging the mounting portion of the first plate. The second portion of the first flange and the second portion of the second flange are each bent towards each, engaging the mounting portion of the third plate.

DETAILED DESCRIPTION

Figure 11:
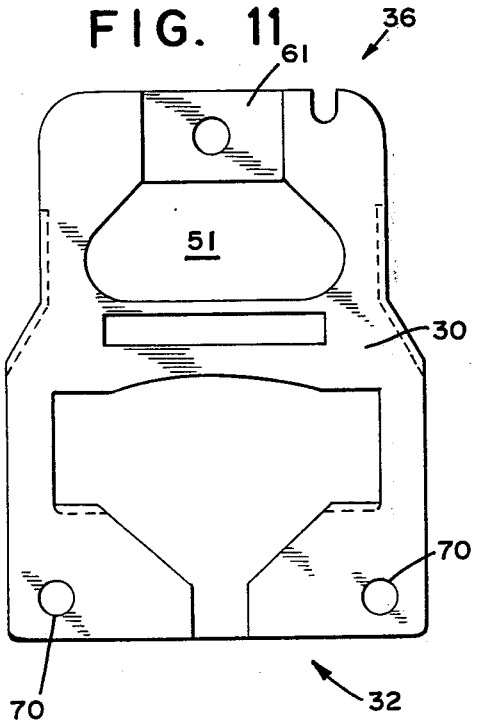
FIG. 11 is a top planar view of a component of the buckle shown in FIG. 1, a third laminate plate.

The present invention is especially well adapted for use with an apparatus, such as a vehicle safety belt system, having a buckle and a stiff member for anchoring the buckle to a structure, such as a floor of an automobile. Referring to FIGS. 1–3 and 9–11, the buckle 20 includes a housing 22 (FIG. 2) within the buckle 20 and a cover 24 (FIG. 2) enclosing the housing 22. Referring to FIGS. 2, 9, 10 and 11, the housing 22 comprises a plurality of laminate plates secured together, including a first or top plate 26 (FIG. 9), a second or middle plate 28 (FIG. 10) and a third or bottom plate 30 (FIG. 11). Referring to FIG. 2, the second plate 28 is arranged between the first plate 26 and the third plate 30. The buckle 20, housing 22, first plate 26, second plate 28, and third plate 30 each have a tongue end 32 at which a tongue 34 is inserted into the buckle 20 and the housing 22; and a mounting end 36 opposite the tongue end 32.

Referring to 1 and 2, the present invention relates to an improvement for connecting the buckle 20 to the stiff member 38, such as a stiff cable. The improvement includes a ferrule 40 having an elongated shape, a buckle end 42 and a mounting end 44. The ferrule 40 has a means at the buckle end 42 of the ferrule 40 for attaching the ferrule 40 to the buckle 20. The ferrule 40 has a means at the mounting end 44 of the ferrule 40 for attaching the ferrule 40 to the stiff member 38.

Figure 1:
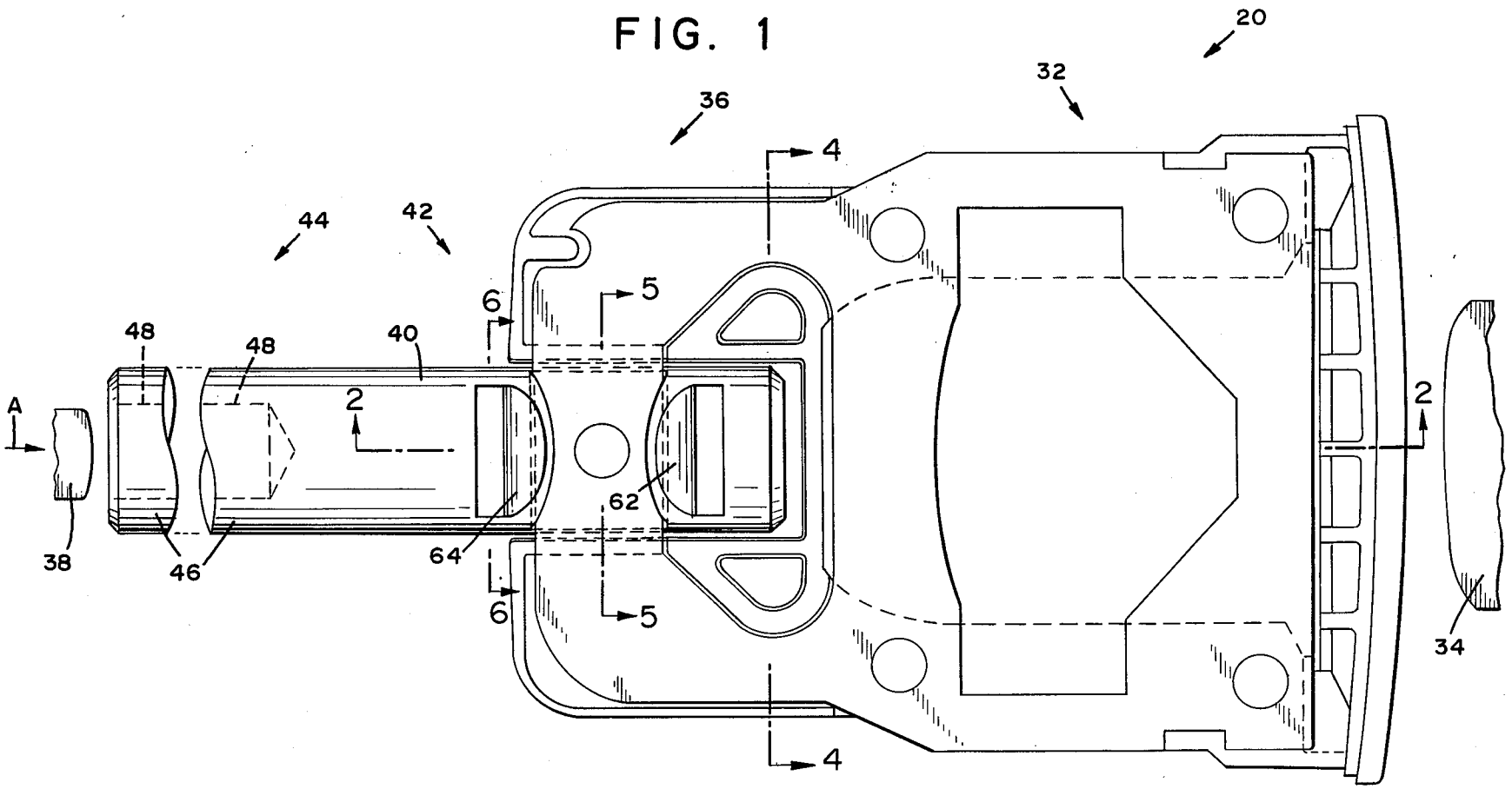
FIG. 1 is a top plan view of the apparatus of the present invention attached to a buckle.
Figure 2:
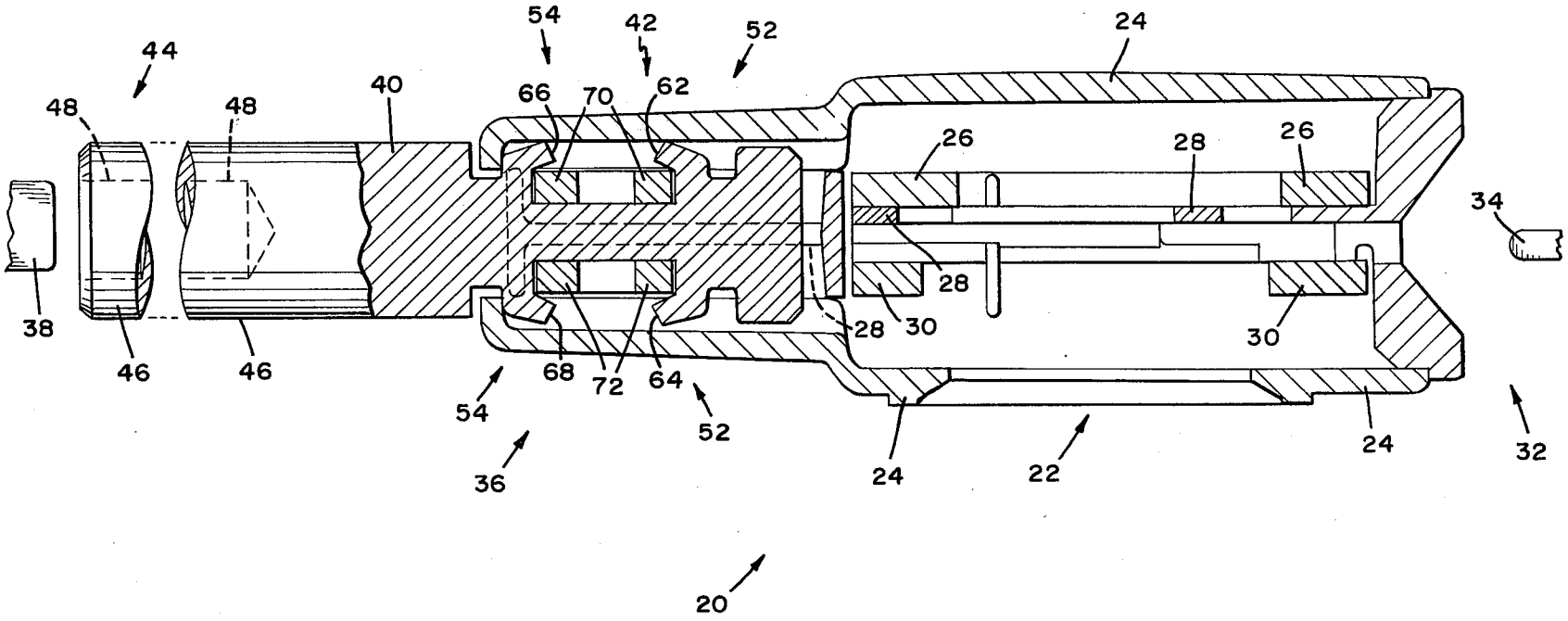
FIG. 2 is a cross-sectional view of FIG. 1 along the lines 2—2.
Figure 3:
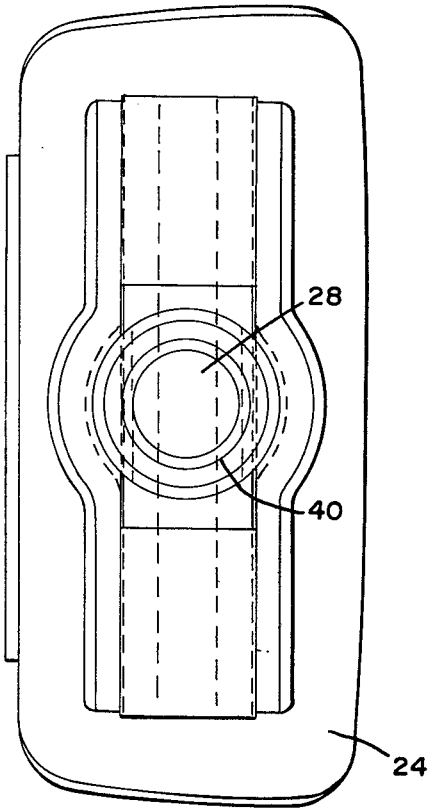
FIG. 3 is an end view of FIG. 1 in the direction of arrow A in FIG. 1.
Figure 4:
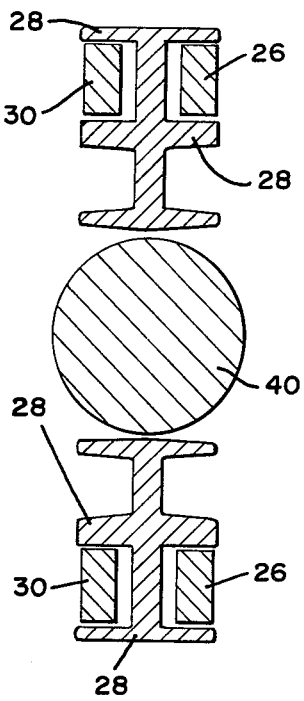
FIG. 4 is a cross-sectional view of FIG. 1 along the lines of 4—4.
Figure 5:
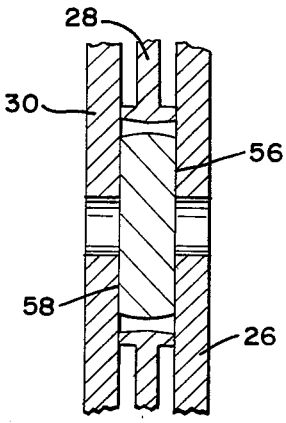
FIG. 5 is a cross-sectional view of FIG. 1 along the lines 5—5.
Figure 6:
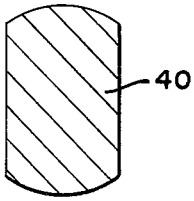
FIG. 6 is a cross-sectional view of FIG. 1 along the lines 6—6.
Figure 7:
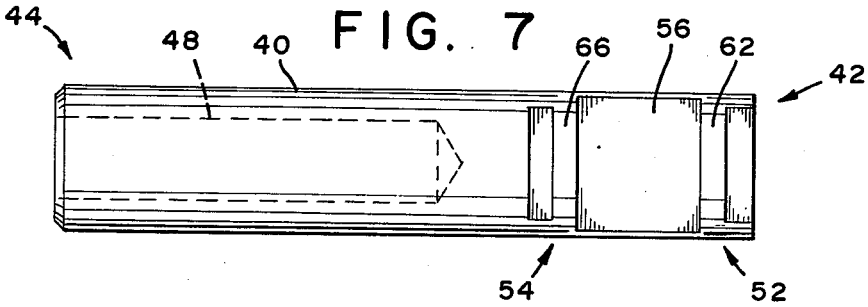
FIG. 7 is a top planar view of a ferrule, which is a component of the apparatus shown in FIG. 1.
Figure 8:
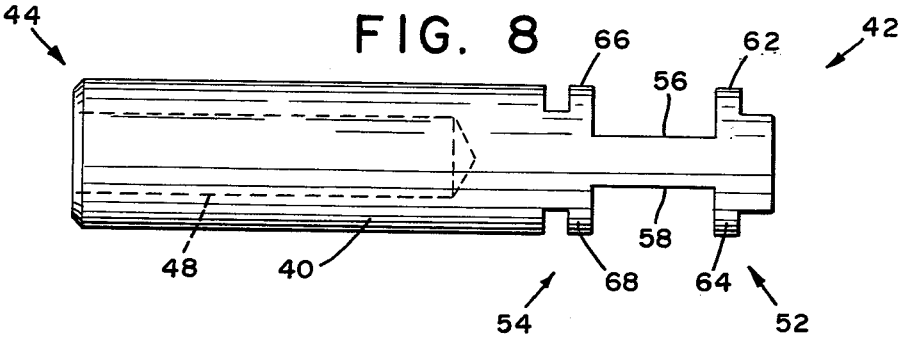
FIG. 8 is a side view of FIG. 7.

Referring to FIGS. 1 and 2, the means at the mounting end 44 of the ferrule 40 for attaching the mounting end 44 of the ferrule 40 to the stiff member 38 includes: a swagable material 46 at the mounting end 44 of the ferrule 40. Preferably, the entire ferrule 40 is made of such swagable material. The mounting end 44 of the ferrule 40 has a central bore 48 therein for receiving the stiff member 38 about which the swagable material is crimped and clamped. The bore 48 has a cross-sectional configuration which conforms to a cross-sectional configuration of a portion of the stiff member to be positioned in the bore 48. In the preferred embodiment, the cross-sectional configurations are round. Other embodiments may have, for example, a square, rectangular, or pentagonal configurations. Referring to FIGS. 7 and 8, the bore 48 extends along a central longitudinal axis of the ferrule 40 for a distance from the mounting end of the ferrule 40 equal to approximately 10 to 75% of the total length of the ferrule 40.

Figure 9:
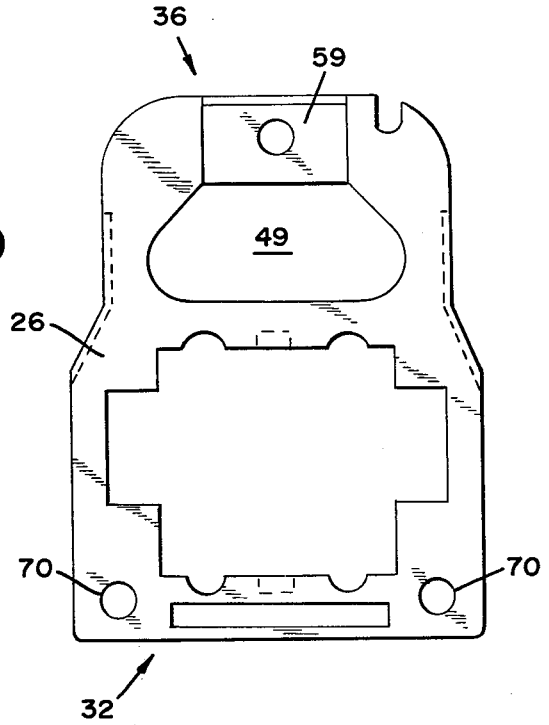
FIG. 9 is a top planar view of a component of the buckle shown in FIG. 1, a first plate.
Figure 10:
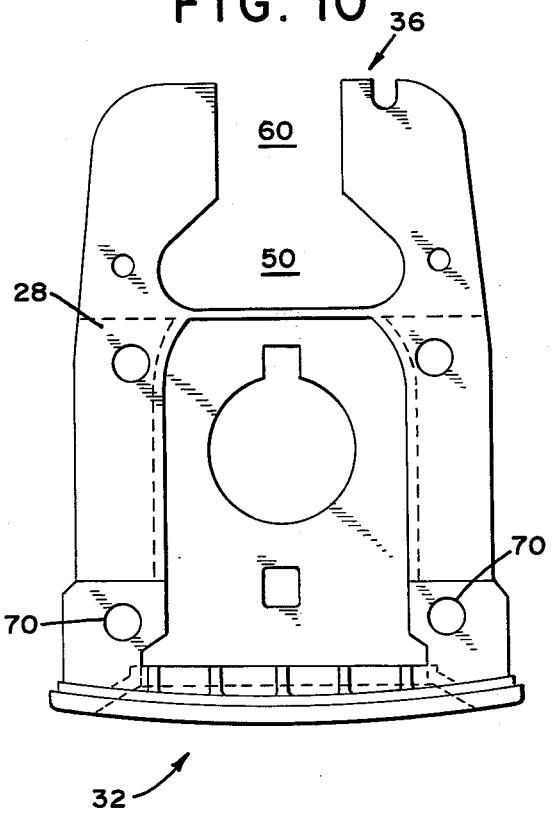
FIG. 10 is a top planar view of a component of the buckle shown in FIG. 1, a second laminate plate.

Referring to FIGS. 9–11 the laminate plates 26, 28 and 30 each have an opening 49, 50 and 51 adjacent to the mounting end 36 of the plates 26, 28 and 30. Referring to FIGS. 1, 2, 7 and 8, buckle end 42 of the ferrule 40, for attaching the buckle end 42 of the ferrule 40 to the buckle 20 includes: a circular first flange 52, a circular second flange 54, a first planar surface 56 and a second planar surface 58. The first planar surface 56 and a second planar surface 58 are located between the first flange 52 and the second flange 54. The first flange 52 of the ferrule 40 is disposed within the opening 49, 50 and 51 of the plates 26, 28 and 30. The second flange 54 of the ferrule 40 is disposed at the mounting end 36 of the plates 26, 28 and 30. Referring to FIG. 10, the second or middle plate 28 has a slot 60 extending along the longitudinal axis of the second plate 28 from the mounting end 36 to the opening 50 of the second plate 28.

The planar surfaces 56 and 58 of the ferrule 40 are disposed within the slot 60 of the second plate 28. The planar surfaces 56 and 58 of the ferrule 40 are also disposed between the first plate 26 and the third plate 30. Referring to FIGS. 9 and 11, the first plate 26 and the third plate 30 each have a mounting portion 59 and 61 located between their mounting ends 36 and their interior opening 49 or 51. A first or top portion 62 of the first flange 52 extends into the interior opening 49 of the first plate 26, adjacent to, and preferably in contact with, the mounting portion 59. A second or bottom portion 64 of the first flange 52 extends into the interior opening 51 of the third plate 30, adjacent to, and preferably in contact with, the mounting portion 61. A first or top portion 66 of the second flange 54 extends adjacent to, and preferably in contact with, the mounting end 36 of the first plate 26. A second or bottom portion 68 of the second flange 54 extends adjacent to, and preferably in contact with, the mounting end 36 of the third or bottom plate 30. Referring to FIG. 2, the first portion 62 of the first flange 52 and the first portion 66 of the second flange 54 are bent towards each other, engaging and clamping the mounting portion 59 of the first plate 26. The second portion 64 of the first flange 52 and the second portion 68 of the second flange 54 are bent towards each other, engaging and clamping the mounting portion 61 of the third plate 30. The plates 26, 28 and 30 are independently secured together by other means, such as screws or rivets 70.

As a means for attaching a laminate buckle 20 to a stiff member 38, the ferrule 40 is strong, simple in design and convenient to manufacture and assembly. The ferrule 40 may be employed with a variety of known buckles and minimizes design changes which would be necessary to attach a buckle to a stiff member for mounting on a structure.

I claim:

1. In an apparatus comprising a buckle and a stiff member for anchoring the buckle to a structure, wherein the buckle includes a housing within the buckle, the housing comprising a plurality of laminate plates secured together, including a first plate, a second plate and a third plate; the second plate arranged between the first plate and the third plate; said laminate plates each having an interior opening adjacent a mounting end of said plates; said buckle, housing, first plate, second plate and third plate each having a tongue end at which a tongue is inserted into the buckle and housing a mounting end, an improvement for connecting the buckle to the stiff member comprising:

a ferrule having an elongated shape, a buckle end and a mounting end; means at said buckle end of said ferrule for attaching said buckle end of said ferrule to said buckle; and means at said mounting end of said ferrule for attaching said mounting end of said ferrule to said stiff member;

said means at said mounting end of said ferrule for attaching said mounting end of said ferrule to said stiff member comprising a swagable material at the mounting end of said ferrule, said mounting end of said ferrule having a bore therein for receiving said stiff member, said bore having a cross-sectional configuration which conforms to a cross-sectional configuration of a portion of said stiff member to be positioned in said bore, said bore extending along a central longitudinal axis of said ferrule from said mounting end of said ferrule to a point along the longitudinal axis of said ferrule between said buckle end and said tongue end;

said means at said buckle end of said ferrule comprises: a first flange, a second flange, a first planar surface and a second planar surface; and said first planar surface and said second planar surface are disposed between said first flange and said second flange; said second plate having a slot extending along a longitudinal axis of said second plate from the mounting end to the interior opening of said second plate, said first flange of said ferrule disposed within said interior opening of said plates, said second flange of said ferrule disposed at said mounting end of said plates, said planar surfaces of said ferrule disposed within said slot of said second plate, and said planar surfaces of said ferrule disposed between said first plate and said third plate;

a first portion of said first flange extending into said interior opening of said first plate and a second portion of said first flange extending into said interior opening of said third plate; a first portion of said second flange extending adjacent to said mounting end of said first plate and a second portion of said second flange extending adjacent to said mounting end of said third plate; said first plate and said third plate each having a mounting portion located between their mounting ends and their interior openings; said first portion of said first flange and said first portion of said second flange are each bent toward each other, engaging said mounting portion of said first plate; and said second portion of said first flange and said second portion of said second flange each bent toward each other, engaging said mounting portion of said third plate.

2. In an apparatus comprising a buckle and a stiff member for anchoring the buckle to a structure, wherein the buckle includes a housing within the buckle, the housing comprising a plurality of laminate plates secured together, including a first plate, a second plate and a third plate; the second plate arranged between the first plate and the third plate; said buckle, housing, first plate, second plate and third plate each having a tongue end and a mounting end, an improvement for connecting the buckle to the stiff member comprising:

a ferrule having an elongated shape, a buckle end and a mounting end; means at said buckle end of said ferrule for attaching said buckle end of said ferrule to said buckle; and means at said mounting end of said ferrule for attaching said mounting end of said ferrule to said stiff member; wherein:

said laminate plates each have an interior opening adjacent said mounting end of said plates and said means at said buckle end of said ferrule comprises: a first flange, a second flange, a first planar surface and a second planar surface; and said first planar surface and said second planar surface are disposed between said first flange and said second flange; and said second plate has a slot extending along a longitudinal axis of said second plate from the mounting end to the interior opening of said second plate, said first flange of said ferrule is disposed within said interior opening of said plates, said second flange of said ferrule is disposed at said mounting end of said plates, said planar surfaces of said ferrule are disposed within said slot of said second plate, and said planar surfaces of said ferrule are disposed between said first plate and said third plate.

3. The safety belt system according to claim 2 wherein:

a first portion of said first flange extends into said interior opening of said first plate and a second portion of said first flange extends into said interior opening of said third plate; and a first portion of said second flange extends adjacent to said mounting end of said first plate and a second portion of said second flange extends adjacent to said mounting end of said third plate.

4. The apparatus according to claim 3 wherein:

said first plate and said third plate each have a mounting portion located between their mounting ends and their interior openings;

said first portion of said first flange and said first portion of said second flange are each bent toward each other, engaging said mounting portion of said first plate; and said second portion of said first flange and said second portion of said second flange are each bent toward each other, engaging said mounting portion of said third plate.

5. In a buckle having a means for anchoring the buckle to a structure and a housing within the buckle, the housing comprising a plurality of laminate plates secured together; said buckle, housing, and plates each having a tongue end and a mounting end, an improvement for connecting the buckle to the anchoring means comprising:

a ferrule having an elongated shape, a buckle end and a mounting end; means at said buckle end of said ferrule for attaching said buckle end of said ferrule to said buckle; and means at said mounting end of said ferrule for attaching said mounting end of said ferrule to said anchoring means; wherein said laminate plates each have an opening adjacent said mounting end of said plates and said means at said buckle end of said ferrule for attaching the buckle end of the ferrule to the buckle comprises: first and second integral flanges disposed on said buckle end of said ferrule and disposed within said opening of said plates for gripping adjacent portions of said plates, portions of said first and second flanges being bent towards each other and engaging said plates.

6. The buckle according to claim 5 wherein: said flanges at said buckle end of said ferrule for attaching said mounting end of said ferrule to said buckle comprises swagable material at the buckle end of said ferrule.

7. In a buckle having a means for anchoring the buckle to a structure and a housing within the buckle, the housing comprising a plurality of laminate plates secured together, said buckle, housing, and plates each having a tongue end at which a tongue is inserted into the buckle and housing a mounting end, each of the laminate plates having an interior opening adjacent to said mounting end, an improvement for connecting the buckle to the anchoring means comprising:

a ferrule having an elongated shape, a buckle end and a mounting end; means at said buckle end of said ferrule for attaching said buckle end of said ferrule to said buckle; and means at said mounting end of said ferrule for attaching said mounting end of said ferrule to said anchoring means;

said means at said mounting end of said ferrule for attaching said mounting end of said ferrule to said anchoring means;

said means at said buckle end of said ferrule for attaching the buckle end of the ferrule to the buckle comprising: a first flange, a second flange, a first planar surface and a second planar surface; and said first planar surface and said second planar surface are disposed between said first flange and said second flange; said second plate having a slot extending along a longitudinal axis of said second plate from the mounting end to the interior opening of said second plate, said first flange of said ferrule disposed within said interior opening of said plates, said second flange of said ferrule disposed at said mounting end of said plates, said planar surfaces of said ferrule disposed within said slot of said second plate, and said planar surfaces of said ferrule disposed between said first plate and said third plate;

a first portion of said first flange extending into said interior opening of said first plate and a second portion of said first flange extending into said interior opening of said third plate; a first portion of said second flange extending adjacent to said mounting end of said first plate and a second portion of said second flange extending adjacent to said mounting end of said third plate; said first plate and said third plate each having a mounting portion located between their mounting ends and their interior openings; said first portion of said first flange and said first portion of said second flange are each bent toward each other, engaging said mounting portion of said first plate; and said second portion of said first flange and said second portion of said second flange each bent toward each other, engaging said mounting portion of said third plate.

8. The buckle according to claim 7 wherein said means at said mounting end of said ferrule comprises a swagable material at the mounting end of said ferrule.

* * * * *